United States Patent [19]

Rivelles Sabater et al.

[11] 4,403,637

[45] Sep. 13, 1983

[54] REINFORCED FLEXIBLE CONTAINER

[76] Inventors: Maria D. Rivelles Sabater, 16, Font de Mora St., Puzol (Valencia); Maria T. Alcalá Perales, 8, Doctor Sumsi St., Valencia; Carmen Mañes Usó, 11, San Vicente St., Tabernes Blanques (Valencia); Maria A. Calabuig Sanchis, 5, Alcalde Reig St., Valencia, all of Spain

[21] Appl. No.: 304,341

[22] Filed: Sep. 21, 1981

[51] Int. Cl.[3] ..... B65D 33/02

[52] U.S. Cl. ..... 150/12; 150/1.7; 150/DIG. 1; 229/55

[58] Field of Search ..... 150/1, 2, 12, 1.7; 229/55

[56] References Cited

U.S. PATENT DOCUMENTS 1,737,065 11/1929 Thornton ..... 150/12

3,154,238 10/1964 Barnhill ..... 229/55

3,454,441 7/1969 Spruyt ..... 150/1.7

FOREIGN PATENT DOCUMENTS

WO82/00475-44 3/1982 PCT Int'l Appl. ..... 229/55

*Primary Examiner*—William Price

*Assistant Examiner*—Sue A. Weaver

*Attorney, Agent, or Firm*—Wenderoth, Lind & Ponack

[57] ABSTRACT

A reinforced flexible container includes a mesh bag having opposite ends and first and second bands of flexible material having opposite ends. The bands are positioned on opposite sides of the bag, with the opposite ends of the bands covering and being joined to respective opposite ends of the bag, and with the bag and the bands being free of any connection or joining between the opposite ends. One joined end of the bag and bands has formed therethrough a carrying opening.

4 Claims, 2 Drawing Figures

REINFORCED FLEXIBLE CONTAINER

BACKGROUND OF THE INVENTION

The present invention relates to an improved reinforced flexible container, particularly suited and manufactured for the storage and carrying of loose packaged items such as fruit or vegetables, although the present invention may be employed for containing other items.

One type of well known package or container for produce items such as fresh fruits and vegetables comprises a tubular bag of mesh or net form, the opposite ends of which are closed, for example by clamping or sewing. However, a disadvantage of this type of container is that the mesh structure thereof has a low strength and resistance to tearing. As a result, this type of container is practically employable for only relatively small quantities of product.

There are also known types of containers employing carrying handles. However, such handles are provided by a separate manufacturing step or steps and thus add to the expense of the container. Furthermore, containers including such handles lack flexibility and thus do not easily fit into useable transportation areas, such as boxes, cases, etc.

Furthermore, known containers, such as traditional mesh or net bags, do not have surfaces capable of receiving advertising indicia or graphics, so that it is necessary to provide such containers with an additional element or elements in the form of labels. However, such labels are easily susceptible of unintentional removal, with the resultant problems of tearing and deterioration of the container, as well as identification of the goods therein.

SUMMARY OF THE INVENTION

With the above discussion in mind, it is the object of the present invention to provide an improved reinforced flexible container which overcomes the disadvantages of prior art containers.

This object is achieved in accordance with the present invention by the provision of a reinforced flexible container including a mesh or net bag having opposite ends, and first and second bands of flexible material having opposite ends. The bands are positioned on opposite lateral sides of the bag, with the opposite ends of the bands covering and being joined to respective of the opposite ends of the bag. The bag and the bands are unjoined and unconnected between the joined opposite ends. One end of the container, i.e. one joined end of the bag and bands, has formed therethrough at least one carrying opening.

The container according to the present invention has increased strength due to the lateral bands offering added support to opposite sides of the mesh bag. The bag and the bands are joined only at the opposite ends, i.e. the upper and lower ends, such that the bag remains unattached to the bands throughout the majority of the length thereof, thereby insuring that the container has sufficient flexibility to receive loose packed items, particularly produce items. Outwardly facing areas of the bands are suitable for the receipt of advertising or identifying indicia or graphics. The mesh or net bag preferably is of the known tubular net or mesh type, and the opposite ends thereof are closed by being joined to the opposite ends of the two bands. The material of the bag and bands may be known thermowelding material, and the joining may be by known thermowelding techniques. Alternatively however, joining may be achieved by other known means, such as gluing or sewing. The overall strength of the container is increased, and a carrying handle is easily provided without the necessity of attaching a separate handle element.

BRIEF DESCRIPTION OF THE DRAWINGS

Other objects, features and advantages of the present invention will be apparent from the following detailed description of one preferred embodiment thereof, taken with the accompanying drawings, wherein.

DETAILED DESCRIPTION OF THE INVENTION

Figure 1:
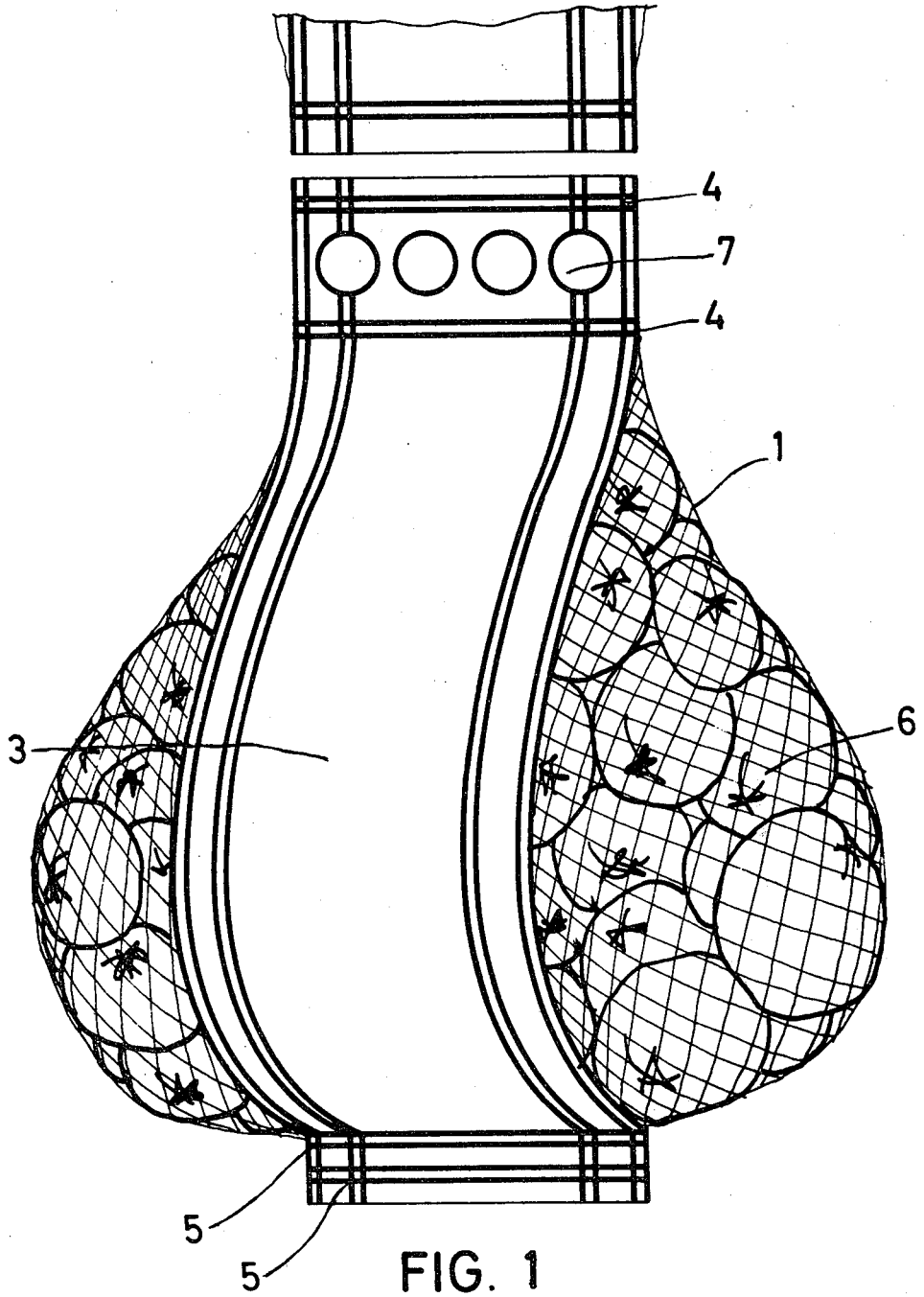
FIG. 1 is a perspective view of one embodiment of a container according to the present invention.
Figure 2:
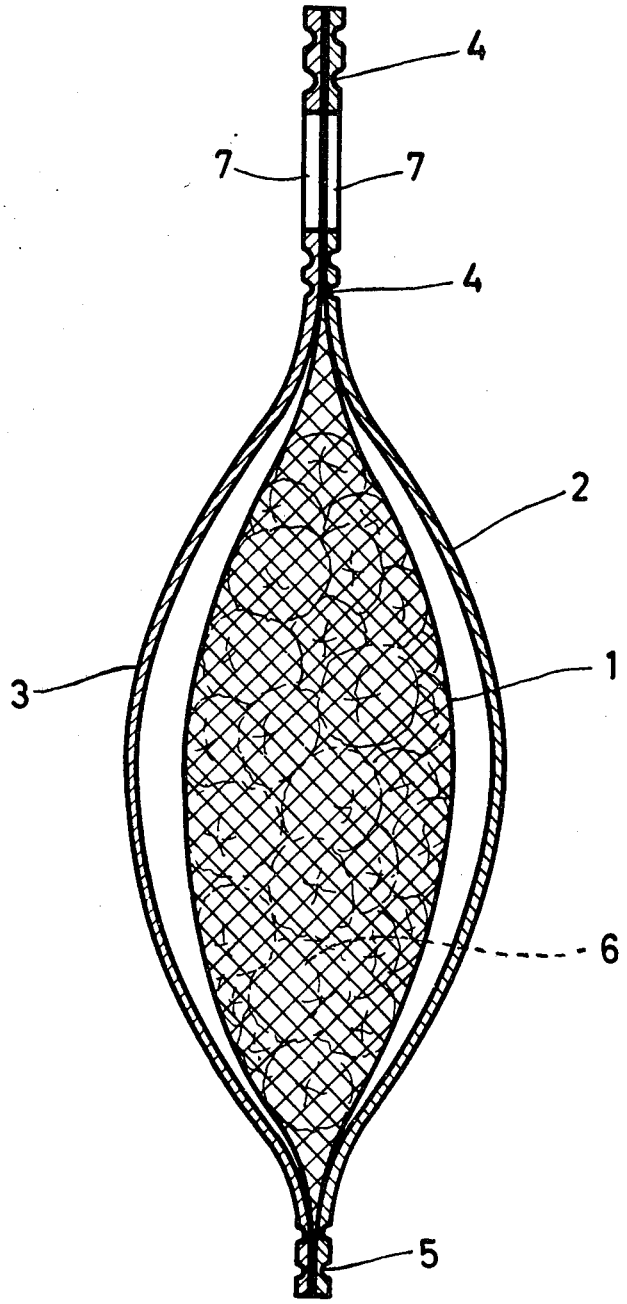
FIG. 2 is a transverse vertical cross-section through the container of FIG. 1.

The following description will be with reference to a container for containing and storing produce items, for example fresh vegetables or fruits. It is to be understood however that the concept of the present invention is applicable to the storage and containing of other items.

In accordance with the present invention, the container includes a mesh or net bag 1, for example of the known tubular type, and formed of a heat sealable or thermoweldable plastic material, of known type. A pair of bands 2, 3 are formed of a flexible material, also of a heat sealable or thermoweldable material. Bands 2, 3 are positioned on opposite sides of bag 1. Opposite ends of the bands 2, 3 cover and are joined to respective opposite ends of bag 1. For example, in the illustrated embodiment, opposite ends of the bands and the bag are joined by heat sealing or thermowelding, as indicated at strips 4, 5. This joining of the bands to the bag closes the opposite ends of the tubular mesh or net bag 1. Between the thermo welding areas or strips 4, 5, the bag 1 remains unconnected and unjoined to the bands 2, 3. It is of course to be understood that the products 6 are supplied into the bag before the final closing thereof.

The upper end of the container has formed therein at least one carrying opening 7. This enables the completed and filled container to be carried without tearing. The holes may be formed by a simple extrusion or punching operation. Although in the illustrated embodiment plural openings 7 are provided, it is to be understood that only one such opening may be provided.

The resultant container is extremely flexible and moldable to any desired place for storage or transportation. Also, the container is much stronger than known net or mesh containers, due to the bands 2 and 3 providing a reinforcing function. As a result, the container may accommodate a much greater load than known produce containers.

The outwardly facing or exterior surfaces of bands 2, 3 may include areas suitable for the receipt of advertising or identifying indicia or graphics, thereby facilitating commercial useage of the container, without the need for the attachment of separate labels.

Although in the illustrated embodiment the joining of the bands to the bag is achieved by thermowelding, other means of such joining, such as gluing or sewing, may be employed.

As indicated above, the container of the present invention provides greater tear resistance, higher adaptability to available transportation space, less expensive manufacture and larger product capacity. Additionally, the container of the present invention enables total ventillation of the produce being carried in the container, thereby enabling flavor preservation, and also enabling the produce goods to be exposed to the view of potential customers.

Although the present invention has been described and illustrated with respect to a preferred embodiment thereof, it is to be understood that various changes and modifications may be made without departing from the scope of the present invention.

We claim:

1. A container comprising:

a mesh bag having opposite ends;

first and second bands of flexible material having opposite ends;

said bands being positioned on opposite sides of said bag, with said opposite ends of said bands covering and being joined to respective said opposite ends of said bag, and with said bag and said bands being free of any connection between said opposite ends; and one said joined end of said bag and bands having formed therethrough at least one carrying opening.

2. A container as claimed in claim 1, wherein outwardly facing surfaces of said bands include areas for the receipt of indicia.

3. A container as claimed in claim 1, wherein said opposite ends of said bag and said bands are joined by mutual thermowelding.

4. A container as claimed in claim 1, comprising plural said carrying openings.

* * * * *